US005996872A

United States Patent [19]

Lawrence

[11] Patent Number: 5,996,872

[45] Date of Patent: Dec. 7, 1999

[54] EDGE POSITION SENSOR WITH INTEGRAL THICKNESS GAUGE

[75] Inventor: Douglas C. Lawrence, Thornton, Pa.

[73] Assignee: Solvetech, Inc., Wilmington, Del.

[21] Appl. No.: 08/874,952

[22] Filed: Jun. 13, 1997

[51] Int. Cl.[6] ..... B65H 26/00; G01B 3/00; G01R 27/26

[52] U.S. Cl. ..... 226/45; 33/501.03; 226/15; 324/662

[58] Field of Search ..... 226/15, 21, 45; 33/501.03; 324/662

[56] References Cited

U.S. PATENT DOCUMENTS

| | | | |
|---|---|---|---|
| 3,323,699 | 6/1967 | Bricker, Jr. | 226/21 |
| 3,676,933 | 7/1972 | Slone | 33/501.03 |
| 3,763,483 | 10/1973 | Urmenyl | 33/501.03 X |
| 4,485,982 | 12/1984 | St. John et al. | 226/15 X |
| 4,952,882 | 8/1990 | Mayer et al. | 324/662 X |
| 5,212,452 | 5/1993 | Mayer et al. | 324/662 |
| 5,530,368 | 6/1996 | Hildebrand | 324/662 |

*Primary Examiner*—Michael R. Mansen
*Attorney, Agent, or Firm*—Klehr, Harrison, Harvey, Branzburg & Ellers, LLP

[57] ABSTRACT

A system for determining the edge of a continuous web and which compensates for non-uniformity in dielectric response, including thickness is disclosed. The invention comprises first electrode for outputting a signal corresponding to the edge position of a continuous web; and second electrode associated with said first electrode for outputting a second signal corresponding to the thickness of the web, such changes in the output signal of the second electrode are related to the output signal of the first electrode.

3 Claims, 3 Drawing Sheets

EDGE POSITION SENSOR WITH INTEGRAL THICKNESS GAUGE

FIELD OF THE INVENTION

The present invention is directed to the field of edge position sensors. In particular, the present invention is directed to edge position sensors having an integral thickness gauge.

BACKGROUND OF THE INVENTION

Edge position measurement is an important requirement in continuous web manufacture processes. There have been a number of edge measuring systems disclosed in the prior art and in the trade literature. The vast majority of these systems operate by optically, pneumatically or physically sensing the edge of a continuous web, and providing a signal to correct the position of the web feeding apparatus with respect to the edge of the web.

Optically based edge measurement systems are expensive and complicated. Prior art dielectric edge sensor technologies have also had a number of technical limitations. One of the main problems associated with conventional edge sensor technologies which depend upon the dielectric response of the base material of the moving web, is that imperfections or anomalies in the web material may vary over the surface area of the web. These imperfections and anomalies, which may exist at various portions of the web, prevent a proper reading and may yield an incorrect measurement. Accordingly, when conventional edge sensors err, they cause an improper shift in the web position or devices which track edge position.

A number of prior art patents have been directed to the problem of properly placing the edge of the uptake roll of a continuous web and in adjusting the position of the web. U.S. Pat. No. 4,381,586 discloses a control system for maintaining a constant predetermined transference with a continuous elastic or extensible web while the web travels longitudinally, and while simultaneously transversely aligning the longitudinally moving web and register with a transversely extending work station which extends across the web at a preset location. The system disclosed in this patent relies upon the use of an optical counter which adjusts the position of a work table in response to lateral movements of the web. This control system is most clearly shown in FIG. 3 and described at column 4, lines 25–70 and utilizes pneumatic pressure sensors, identified by reference numerals 35 and 36.

U.S. Pat. No. 4,888,717 discloses a method and apparatus for controlling the lateral position of a moving web of material having a central longitudinally web access extending generally parallel to the direction of movement of the web so as to maintain the central longitudinally extending access of the web at a substantial constant lateral position. This position is fixed longitudinally and is associated with a fixed web alignment station. As most clearly shown in FIG. 19 and at column 20, this invention utilizes an optical eye in conjunction with an encoder to adjust lateral position of the web in order to make lateral adjustments.

U.S. Pat. No. 4, 956,964 is directed to an adjustable pouch form, fill seal machine. The web is folded upon itself and transversely sealed. The invention incorporates lateral adjustment mechanism which uses an optical counter. Finally, U.S. Pat. No. 5,345,863 is directed to continuous web printing apparatus which includes a mechanical lateral shift device.

None of the prior art discloses or suggests an edge position sensor in combination with a gauge which measures a web property such as thickness, density, composition, moisture or temperature. It would be desirable to provide an edge sensor mechanism which includes a gauge. Such a device would enable the rapid and accurate placement of a web on an uptake roll and would compensate for anomalies in the material, caused by changes in web property. Such a device would compensate for the inherent problems associated with prior art web sensing technologies and would be an improvement over optical, mechanical and pneumatic devices which are often expensive and inaccurate.

SUMMARY OF THE INVENTION

In accordance with the present invention, a system for determining the edge of a continuous web and adjusting for changes in web properties is disclosed. The combination provides a vastly improved edge sensor. In accordance with the present invention, a system for determining the edge of a continuous web and adjusting for changes in a property such is disclosed. The invention comprises first electrode means for outputting a signal corresponding to the edge position of a continuous web; and second electrode means associated with said first electrode means for outputting a second signal corresponding to a property of the web, such changes in the output signal of the second electrode means are related to the output signal of the first electrode means. The web property under measurement may be thickness, density, moisture content, composition or temperature.

In yet a further embodiment, the present invention comprises a gauge for determining the edge of a continuous web and adjusting for changes in web thickness comprising; first capacitive gauge means for outputting a first signal proportional to the position of the edge of the web; and second capacitive gauge means for outputting a second signal proportional to the thickness of the web, said second capacitive gauge means being in association with said first capacitive gauge means, such that changes in the second signal adjust said first signal.

In still a further embodiment, the present invention is directed to a system for determining the edge position of a continuous web and adjusting for changes in thickness arising from imperfections in the web comprising; first rectangular shaped capacitive gauge means situated proximate to said continuous web for outputting a first signal proportional to the position of the edge of the web; and second rectangular shaped capacitive gauge means situated proximate to said continuous web for outputting a second signal proportional to the thickness of the web, said second capacitive gauge means being in association with said first capacitive gauge means, such that changes in the second signal resulting from changes in the thickness of said web adjust said first signal.

DETAILED DESCRIPTION OF THE PREFERRED EMBODIMENT

Figure 1:
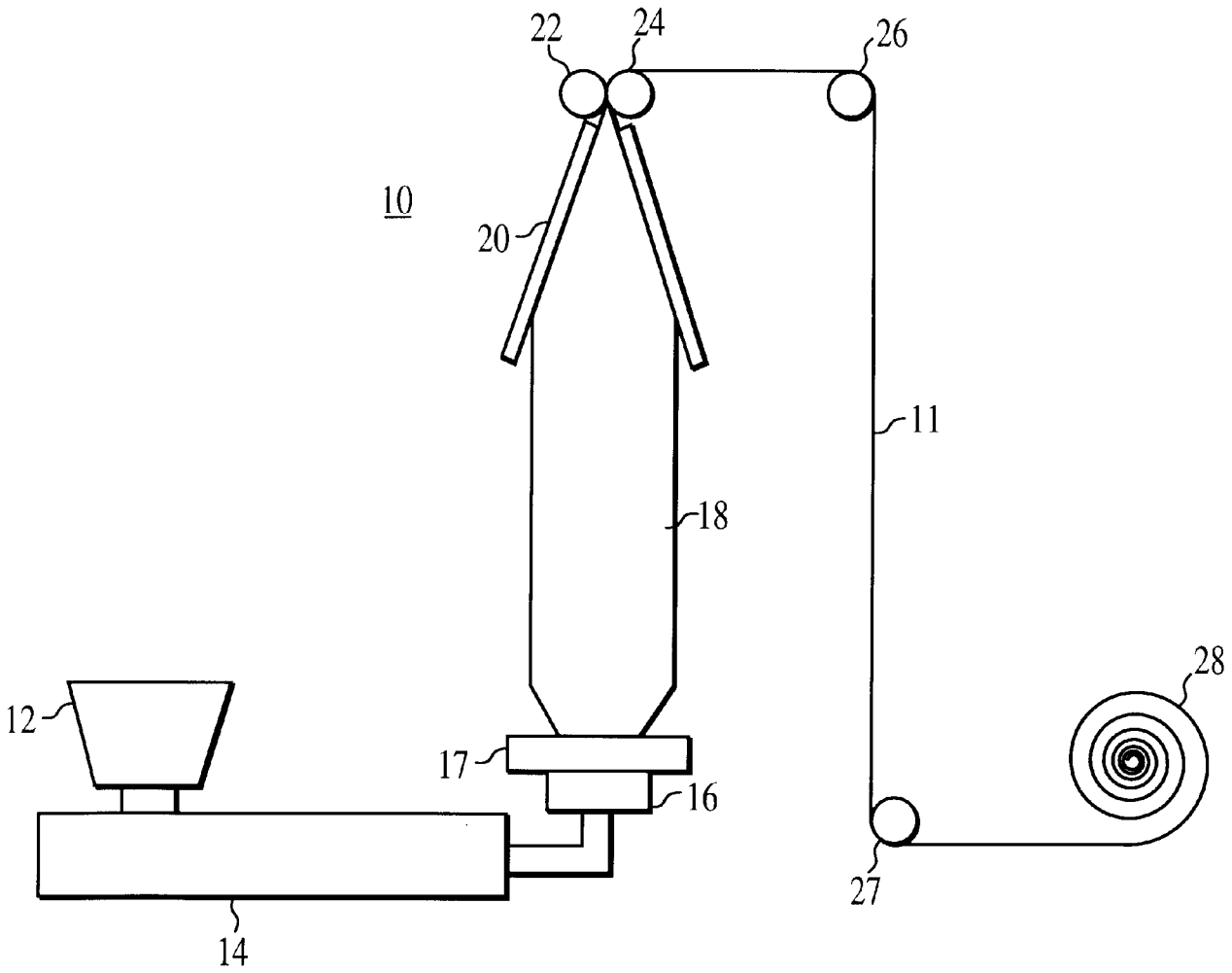
FIG. 1 is a schematic representation of a continuous web fabrication system of the present invention.

The present invention is described with reference to the enclosed figures wherein the same numbers utilized are applicable. Referring to FIG. 1, the present invention is shown in the context of a continuous web extruder 10. Such a web extruder may be utilized, for example, to make polymeric sheets, plastic bags and the like.

The system 10 shown in FIG. 1 is described in the context of a plastic film fabricator and includes a hopper 12 into which the polymeric base material is fed, extruder 14, die 16, air ring 17, bubble 18 and collapsing frame 20. Pairs of nip rollers 22, 24 squeeze the web as it is fed. The web 11 is then picked up by idle rollers 26, 27 and onto a roll of film 28. All of these components are conventional and well known to those skilled in the art. While the present invention is being described in the context of a plastic bag extruder, it is to be appreciated that the present invention is applicable to plastics, glasses, rubbers, papers and other insulators.

Figure 2:
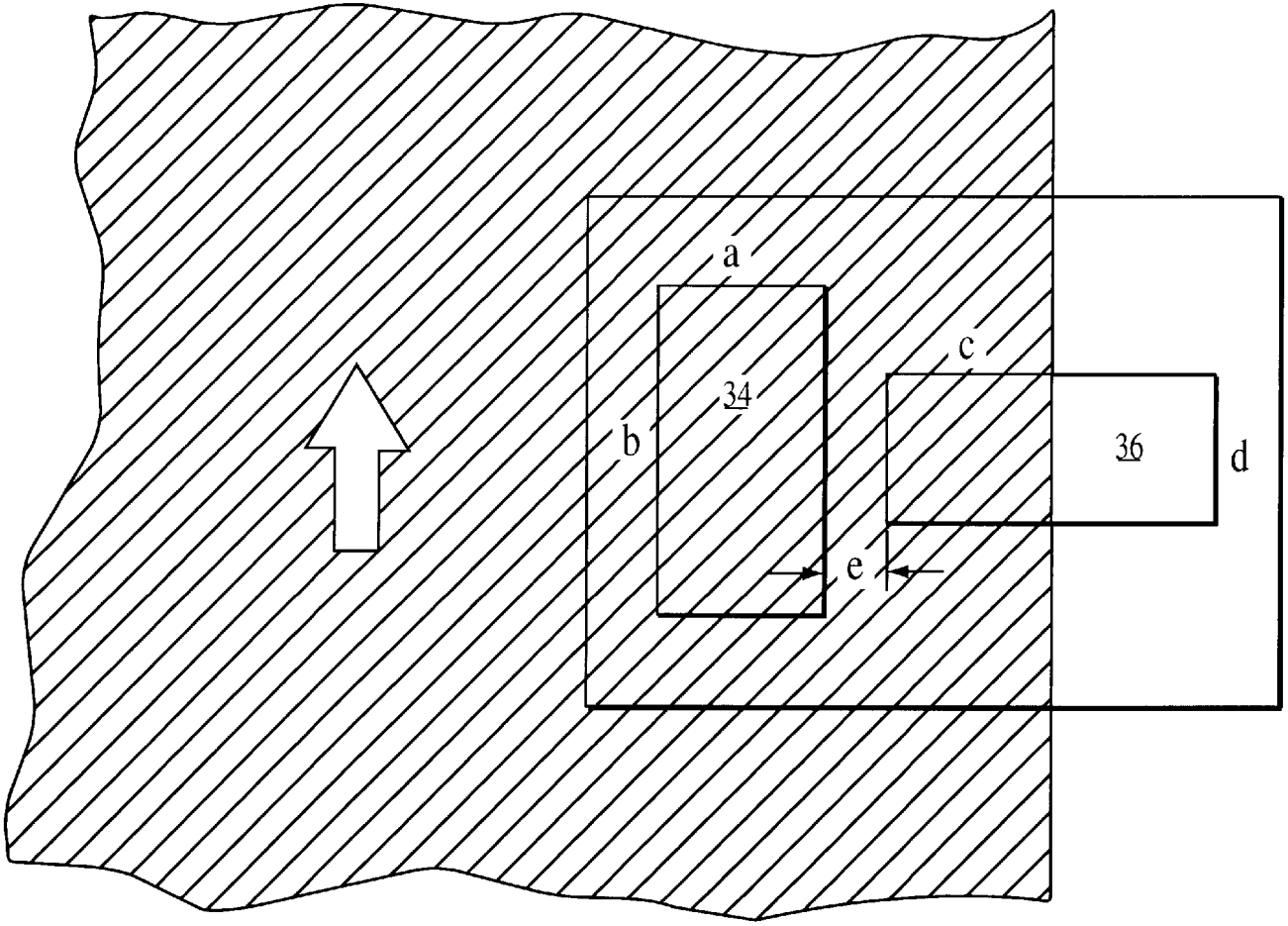
FIG. 2 is a schematic diagram of the edge position sensor with integral thickness gauge of the present invention.
Figure 3:
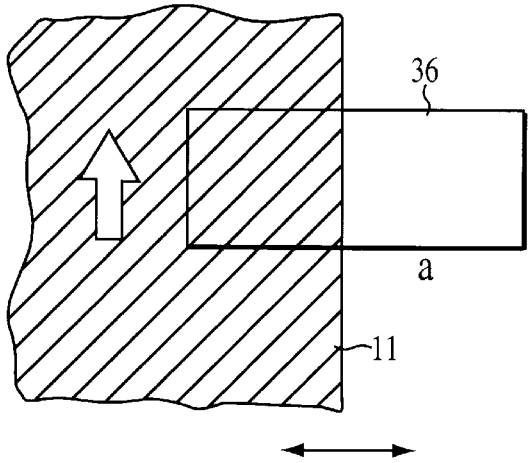
FIG. 3 is a top-down view of the edge position sensor of the present invention.
Figure 4:
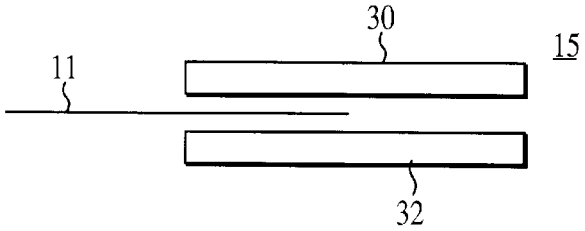
FIG. 4 is a side perspective view of the web being fed through the sensor.
Figure 5:
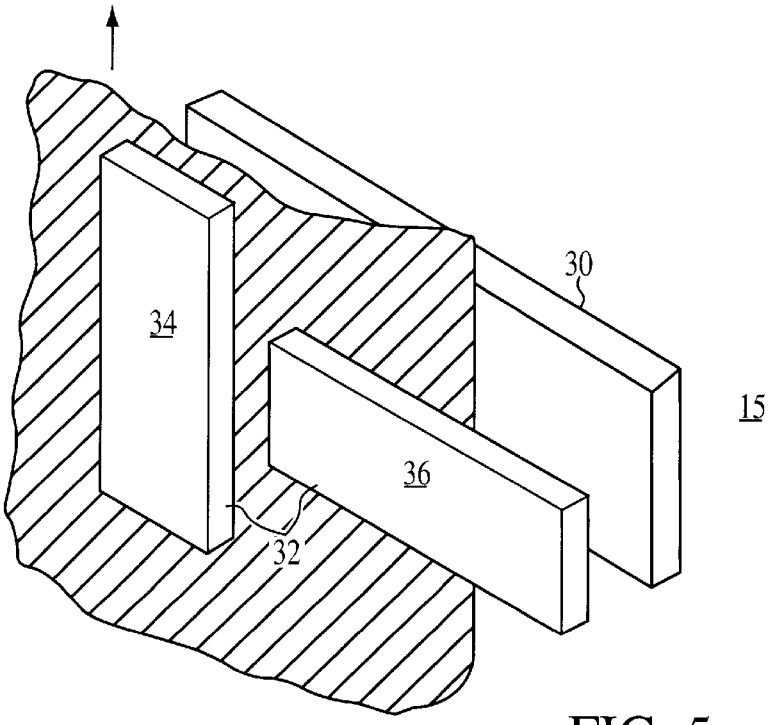
FIG. 5 is an elevation view of the electrodes of the present invention.

Referring now to FIG. 2 though FIG. 5, the present invention is shown in the context of a combination thickness gauge and edge sensor of the present invention. The combination gauge 15 of the present invention comprises two pairs of electrodes 30, 32 which straddle the moving web 11, preferably downstream of the first idle roller 26.

The first electrode 30 comprises a flat metallic plate and may be constructed of steel, copper or other conductive metal. The second electrode 32 is divided into two electrodes 34, 36. The first electrode 34 comprises a capacitive gauge which functions, in one embodiment as a thickness electrode.

Electrode 34, as will be discussed herein, compensates for anomalies in the material under measurement. It also provides data for calculation and identifies a "no material" situation. This electrode 34, in the preferred embodiment, is rectangular in shape. It is to be appreciated that electrodes having other shapes will satisfy the teachings of the present invention.

It is to be noted that the total dielectric response of the material under measurement is a function of a number of variables including thickness density, composition, temperature and moisture. In various applications, some or all of these variables may be constant. In the case of plastics, as exemplified herein, because variables other than thickness are constant, the electrode 34 is preferably a thickness gauge. For other materials, electrode 34 will measure other variables such as density, composition, moisture or temperature.

The second electrode 36 comprises an edge sensing electrode and is also a capacitive gauge. Electrode 36 is also preferably rectangular in shape. In the preferred embodiment, both rectangular shaped electrodes 34, 36 are disposed oppositely such that the orientation of long sides of the first electrode 34 is transverse to the orientation of the second electrode 36. Both sets of electrodes 30, 32 sandwich the web material as it is fed past the electrode. In a preferred embodiment, the area of the thickness sensing electrode 34 should be equal to the area of the edge electrode such that the product of the sides of electrode 34 (a×b) equal the product of the sides of electrode 36 (c×d).

The capacitance of the thickness electrode 34 with respect to opposing electrode 30 ($C_{T,O}$) is a function of the thickness and dielectric properties of the web material. The capacitance of the edge electrode 36 with respect to the opposing electrode 30 ($C_{E,O}$) is a function of the percentage coverage of electrode 36 such that:

$$\text{Position} = f\frac{(C_{E,O} - C_{E,O}(\text{air}))}{C_{T,O} - C_{T,O}(\text{air})}$$

The invention incorporates conventional circuitry to calculate and adjust the position of the web based upon the above relationships. The circuitry utilizes capacitance to voltage converters which convert the signals into a signal which senses the position of the web. The voltage signal of the thickness electrode $V_T$ minus a constant is the full coverage response ($V_{TFULL}$). The voltage of the edge electrode $V_E$ minus a constant divided by $V_{TFULL}$ yields the percentage of web coverage. The percentage of web coverage multiplied by a constant yields the position of the edge. The present invention thus provides a system for accurately monitoring and adjusting the edge of a continuous web based upon changes in web thickness. As noted above, the principles of the present invention, while described in one embodiment as incorporating a thickness electrode, are applicable to materials in which electrode 34 may measure moisture, density, composition or any other property of the web material.

The present invention has been described with reference to the enclosed figures and the above described embodiment. It is to be appreciated that other embodiments fulfill the spirit and scope of the present invention and that the true nature and scope of the present invention is to be determined with reference to the claims appended hereto.

We claim:

1. A system for determining the edge of a continuous web and adjusting for changes in the thickness of the web caused by web anomalies comprising:

first electrode means for outputting a signal corresponding to the edge position of a continuous web;

second electrode means electronically connected with the said first electrode means for outputting a second signal corresponding to the thickness of the web such that changes in the output signal of the second electrode means caused by changes in the thickness of the continuous web adjust the output signal of the first electrode.

2. A gauge for determining the edge of a continuous web and adjusting for changes in the thickness of a continuous web of a polymeric sheet comprising:

first capacitive gauge means for outputting a first signal proportional to the position of the edge of the continuous web of said polymeric sheet;

second capacitive gauge means for outputting a second signal proportional to the thickness of the continuous web, said second capacitive gauge means being electronically connected with said first capacitive gauge means, such that changes in the second signal caused by changes in the thickness of the continuous web adjust the signals of said first capacitive gauge to account for said changes in web thickness.

3. A system for determining the edge position of a continuous web of a polymeric material and adjusting for changes in thickness arising from imperfections in the web comprising:

first rectangular shaped capacitive gauge means situated proximate to said continuous web for outputting a first signal proportional to the position of the edge of the web;

second rectangular shaped capacitive gauge means situated proximate to said continuous web for outputting a second signal proportional to the thickness of the continuous web, said second capacitive gauge means being electronically connected with said first capacitive gauge means, such that changes in the second signal resulting from changes in the thickness of said web adjust the signal of said first gauge to account for said changes in web thickness.

* * * * *